US006646368B2

(12) United States Patent
Park

(10) Patent No.: US 6,646,368 B2
(45) Date of Patent: Nov. 11, 2003

(54) SHADOW MASK IN COLOR CATHODE RAY TUBE

(75) Inventor: Soo Kil Park, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 107 days.

(21) Appl. No.: 09/840,238

(22) Filed: Apr. 24, 2001

(65) Prior Publication Data

US 2001/0048270 A1 Dec. 6, 2001

(30) Foreign Application Priority Data

May 30, 2000 (KR) ..... 2000-29386
May 30, 2000 (KR) ..... 2000-29387

(51) Int. Cl.[7] ..... H01J 9/18
(52) U.S. Cl. ..... 313/402; 313/407
(58) Field of Search ..... 313/402

(56) References Cited

U.S. PATENT DOCUMENTS 4,230,930 A * 10/1980 Chang et al. ..... 219/121.64
4,638,212 A * 1/1987 Nakamura ..... 313/408
4,652,791 A * 3/1987 Palac et al. ..... 313/402
4,828,523 A * 5/1989 Fendley et al. ..... 445/30
5,041,756 A * 8/1991 Fairbanks ..... 313/407

* cited by examiner

*Primary Examiner*—Sandra O'Shea
*Assistant Examiner*—Dalei Dong
(74) *Attorney, Agent, or Firm*—Fleshner & Kim, LLP

(57) ABSTRACT

A shadow mask for a color cathode ray tube provided which includes an effective surface part having a plurality of slots formed therein for passing electron beams, and an edge part extended from the effective surface part and welded to a frame fitted to a panel in a cathode ray tube. The shadow mask is tensed in any one of an x- and y-axis directions. An interval of welding spots on the edge part is fixed according to a thickness of the shadow mask and a pitch of slots of the shadow mask. The interval of welding spots is in a range of approximately 11 to 15 times the thickness of the shadow mask. The welding spots on the edge part has an aspect ratio in a range of approximately 1.0 to 2.6.

20 Claims, 5 Drawing Sheets

SHADOW MASK IN COLOR CATHODE RAY TUBE

BACKGROUND OF THE INVENTION

1. Field of the Invention

The present invention relates to a color cathode ray tube, and more particularly, to a shadow mask in a color cathode ray tube that can prevent formation of wrinkles on the shadow mask effectively occurred after welding.

2. Background of the Related Art

A related art color cathode ray tube will be explained with reference to FIGS. 1 and 2.

The related art color cathode ray tube is provided with a panel 1 having a fluorescent film 9 coated on an inside surface thereof, a funnel 3 having conductive carbon coated on an inside surface thereof, both of which are welded together with fusion glass. There is an electron gun 5 in one end of the funnel 3, for emitting electron beams, and a deflection yoke 7 on a neck portion of the funnel 3 for deflecting the electron beams. There is a shadow mask 30 fitted to a frame 13 for selecting colors to make the fluorescent film 9 on the inside surface of the panel 1 luminant. The frame 13 is fitted to stud pins 19 on the panel 1 by using springs 17. There is an inner shield 21, a magnetism shielding body, fitted to a rear of the frame 13 for preventing the electron beams from deviating off an original path by an influence of an external geomagnetism. The color cathode ray tube has a danger of implosion owing to a high vacuum inside of the color cathode ray tube. For preventing this, the panel 1 is designed to have a structural strength to withstand the atmospheric pressure. A reinforcing band 23 is strapped around a skirt of the panel 1 for dispersing a stress on the cathode ray tube of high vacuum for enhancing an impact resistance.

An assembly of the shadow mask and the frame will be explained in detail with reference to FIGS. 3~6.

The shadow mask 30 is provided with an effective surface part 32 having a plurality of electron beam pass through holes, i.e., slots 38, formed therein for passing the electron beams from the electron gun 5 to make the fluorescent film 9 ruminant, and an edge part 34 having no slots 38 formed thereon for reinforcing a strength of the effective surface part 32. The edge part 34 is welded to the frame 13, to assemble the shadow mask 30 to the frame 13.

In the meantime, the shadow mask 30 is designed to prevent the shadow mask 30 from being vibrated, i.e., to prevent howling. That is, a tension is applied to the shadow mask 30 in up and down directions (when the cathode ray tube is seen in front thereof), for increasing a natural frequency of the shadow mask 30, thereby preventing the howling, which will be explained in detail. As shown in FIG. 3, a compressive load 'P' is applied to the frame 13 of an appropriate rigidity at first. Then, as shown in FIG. 4, in a state the compressive load 'P' is applied to the frame 13, the shadow mask 30 is placed on the frame 13 and welded by using a welding roller 40, and the compressive load to the frame 13 is removed, to allow the frame 13 to restore an original position by an elastic force, thereby making a state in which the tension is applied to the shadow mask 30.

The operation of the related art color cathode ray tube will be explained briefly.

When a video signal is received at the electron gun 5, thermal electrons are emitted from the electron gun 5, and travel toward the panel 1 while the thermal electrons are accelerated and focused by acceleration electrodes and focusing electrodes in the electron gun 5. In this instance, a path of the electron beams are adjusted by the deflection yoke 7 for directing onto the inside surface of the panel 1. The electron beams directed toward the panel is involved in color selection as the electron beams pass through the slots 38 in the shadow mask 30, and the selected electron beams hit onto the fluorescent film 9 on the inside surface of the panel 1, to make the fluorescent film ruminant, that reproduces a video signal.

Currently, a high precision, and light weighted cathode ray tube is required, which may be attained by reducing a pitch Ph of the shadow mask 30 or making a thickness of the shadow mask 30 thinner. However, the reduced pitch Ph of, or thinner shadow mask 30 causes another problem in that it is difficult to avoid formation of wrinkles owing to deformation of the shadow mask 30 after welding, because stress concentration around a welding point 36 varies with the thickness 't' and the horizontal pitch Ph of the shadow mask 30. That is, as shown in FIG. 6, when the compressive force 'P' is removed after welding the shadow mask 30, the tension is applied to the shadow mask 30 to concentrate the stress around the welding point 36. The stress in the vicinity of the welding point 36 is higher than an average stress $\sigma_n$, and becomes the higher as it goes nearer to the welding point $\sigma_3>\sigma_2>\sigma_1$, until a maximum stress exceeds a yielding stress, when a plastic deformation occurs, to form the wrinkles.

Therefore, for attaining a high precision and light weighted cathode ray tube by providing finer pitches of the slots and thinner shadow mask, though an appropriate measure is required for preventing the stress concentration to a certain limit, suggestion of such a measure has not be an easy work to do.

SUMMARY OF THE INVENTION

Accordingly, the present invention is directed to a shadow mask in a color cathode ray tube that substantially obviates one or more of the problems due to limitations and disadvantages of the related art.

An object of the present invention is to provide a shadow mask in a color cathode ray tube, which can effectively prevent formation of wrinkles on the shadow mask after welding while a finer pitch of slots and a thinner shadow mask are provided.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the shadow mask in a color cathode ray tube includes an effective surface part having a plurality of slots formed therein for passing electron beams, and an edge part extended from the effective surface part and welded to a frame fitted to a panel in a cathode ray tube, wherein an interval of welding spots on the edge part is fixed according to a thickness of the shadow mask and a pitch of slots of the shadow mask.

The interval of the welding spots is preferably in a range 11–19 times of the thickness of the shadow mask. And, the interval of the welding spots is preferably in a range 0.5–1.9 times of the slot pitch of the shadow mask.

The welding spot on the edge part has preferably an aspect ratio in a range of 1.0–2.6. And, the welding spot on the edge part has preferably a height in a range of 0.6 mm–0.9 mm, and a width in a range of 1.0 mm–1.4 mm.

Thus, the present invention permits to set up an optimal form of the welding spot that causes to form no wrinkles regardless of the thickness and the pitch, thereby preventing defective shadow mask coming from occurrence of wrinkles effectively, to improve productivity and to save cost by reduction of defects.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
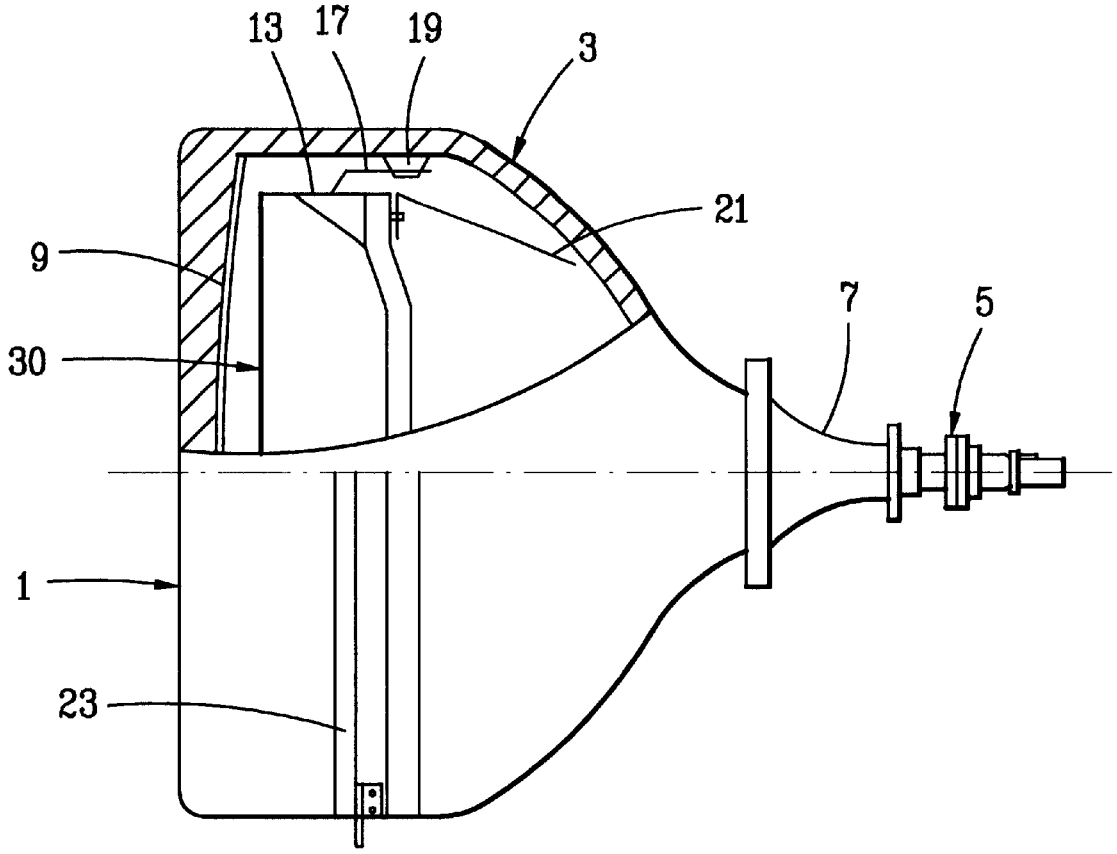
FIG. 1 RELATED ART
FIG. 1 illustrates a side view with a partial cut away view of a related art color cathode ray tube.
Figure 2:
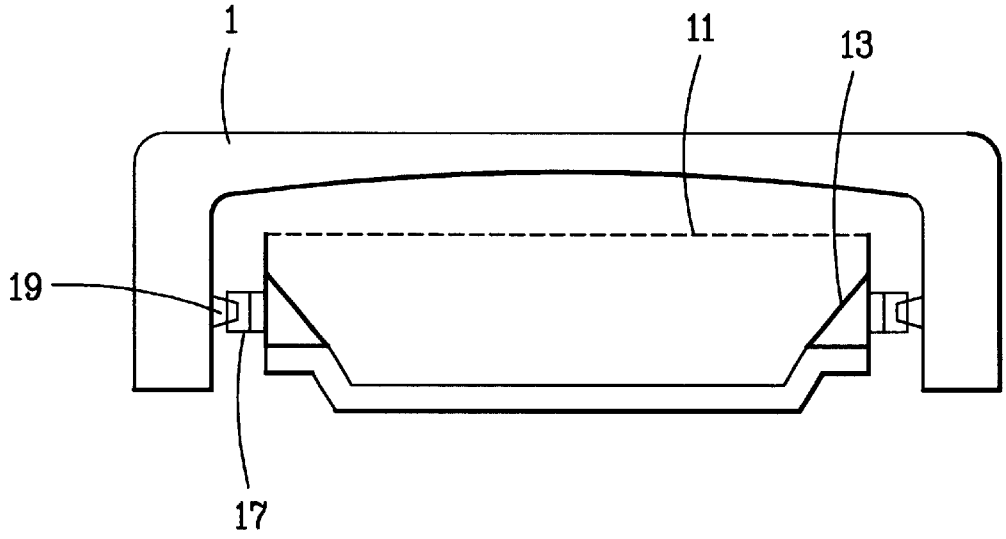
FIG. 2 RELATED ART
FIG. 2 illustrates a section of a related art shadow mask assembly in a color cathode ray tube.
Figure 3:
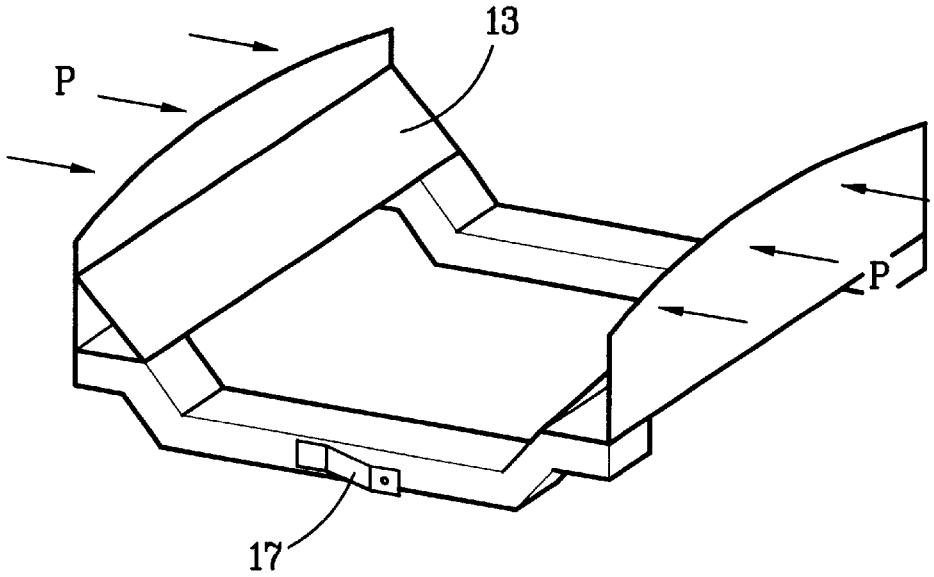
FIG. 3 RELATED ART
FIG. 3 illustrates a perspective view of a frame in FIG. 2.
Figure 4:
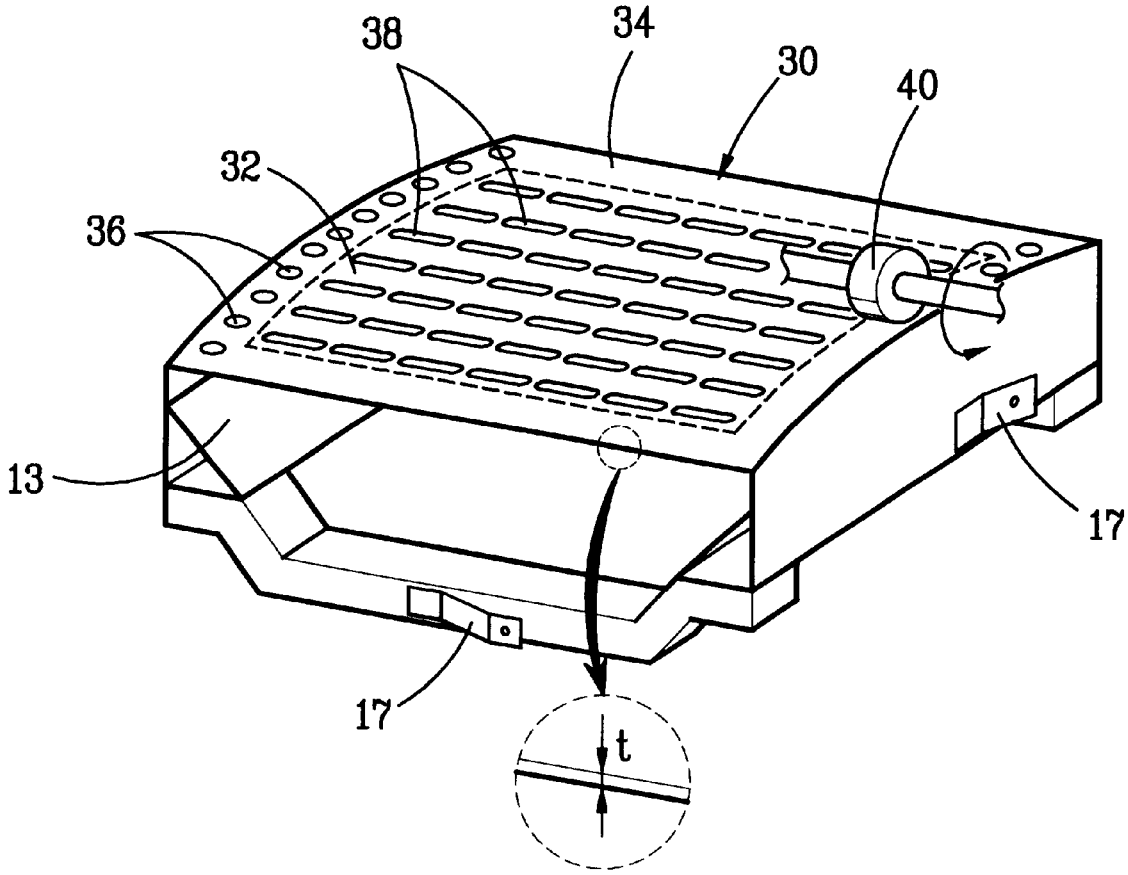
FIG. 4 RELATED ART
FIG. 4 illustrates welding of a shadow mask in a related art color cathode ray tube, schematically.
Figure 5:
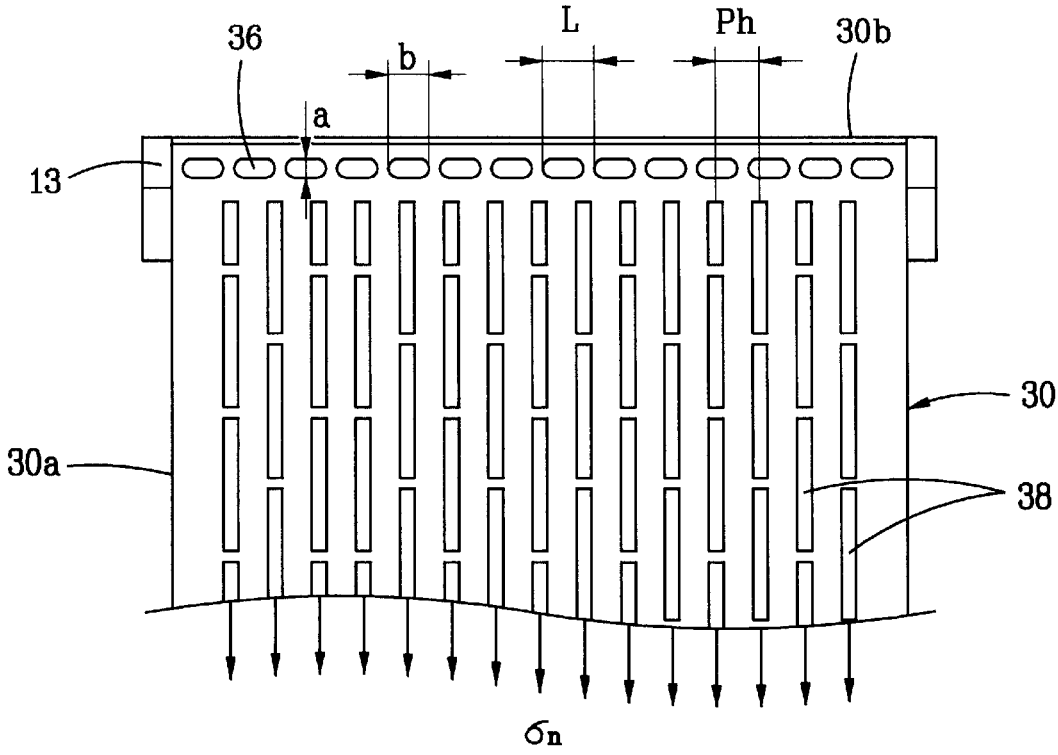
FIG. 5 illustrates a plan view of welding spots on a shadow mask when the shadow mask is welded, schematically.
Figure 6:
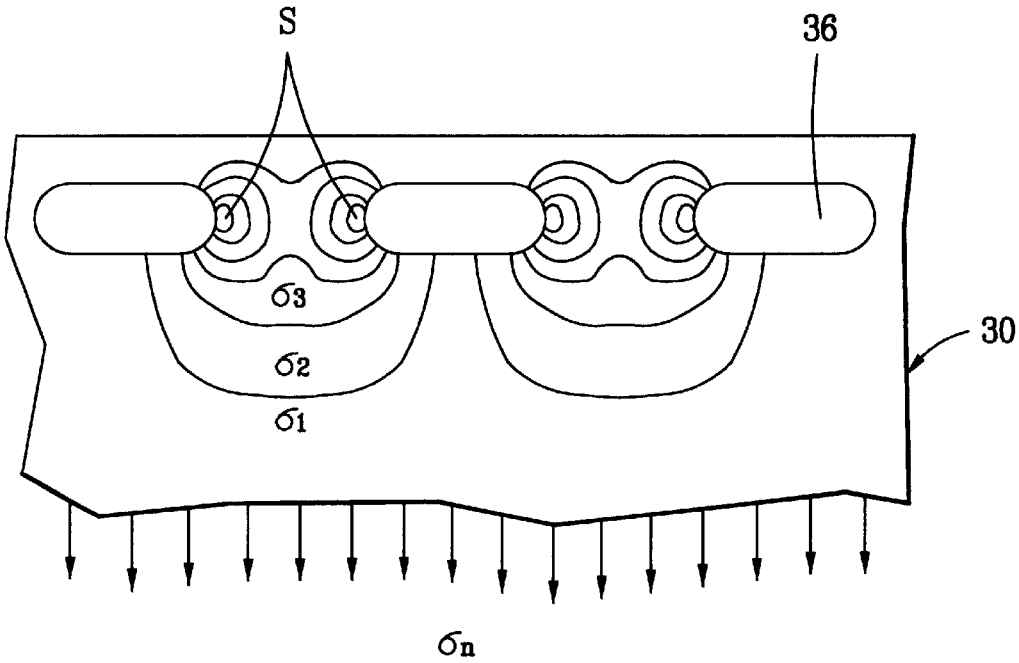
FIG. 6 illustrates a stress state diagram showing stress concentration occurred in a shadow mask; and, FIG. 7 illustrates a graph showing overall geometry (slot pitches, thickness, and welding intervals) of a shadow mask, or geometry (height and width, and an aspect ratio thereof) of a welding spot versus a stress concentration factor.

Reference will now be made in detail to the preferred embodiments of the present invention, examples of which are illustrated in the accompanying drawings. In explaining the embodiments of the present invention, the same components will be given the same names and reference symbols, and additional explanations of which will be omitted. The shadow mask, and the frame the shadow mask is fitted thereto in the present invention are identical to the same in the related art. The present invention suggests varying intervals of welding spots on the shadow mask with a thickness and a pitch of slots of the shadow mask appropriately, for minimizing a stress concentration occurred in the vicinity of the welding spot. Together with the variation of the intervals of welding spots, a form of the welding spot on the shadow mask, i.e., a height, a width, and an aspect ratio, of the welding spot, are varied for minimizing the stress concentration in the vicinity of the welding spot. The shadow mask in a color cathode ray tube of the present invention will be explained, with reference to FIGS. 5 and 6.

A maximum stress of a stress concentration can be in general expressed as follows.

$$\sigma(\max)=Kt*\sigma_n$$

Where, $\sigma(\max)$ denotes a maximum stress in a stress concentration, Kt denotes a stress concentration factor, and $\sigma_n$ denotes an average stress. As can be known from the equation, the greater the stress concentration factor, the higher the maximum stress. The maximum stress occurred in the vicinity of the welding spot on the shadow mask can also be represented with the equation, and forms wrinkles if the maximum stress exceeds a yielding stress. Therefore, if the stress concentration factor is made smaller, which in turn makes the maximum stress, the occurrence of wrinkles in the vicinity of the welding spot can be prevented. However, though it is known that the stress concentration factor is related to a form of section and a load thereon, mechanical calculation of the stress factor is in fact impossible. The inventor finds out through much effort such as computer simulations and experiments that the stress concentration factor in the vicinity of the welding spot is related to the following factors of all of geometrical factors of the shadow mask.

$$Kt=f(t, Ph, L),$$

Figure 7:
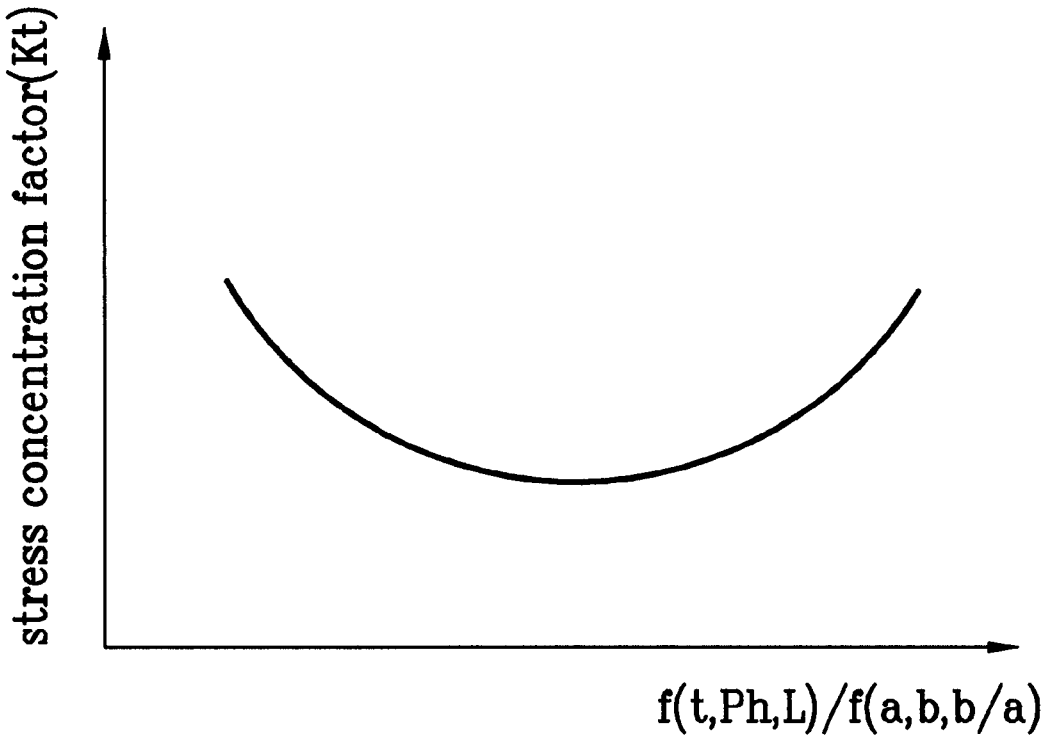

Where, Kt denotes a stress concentration factor, 't' denotes a thickness of the shadow mask, and 'Ph' denotes a horizontal pitch of slots, and 'L' denotes an interval between welding spots. That is, as shown in FIG. 7, it is verified that the stress concentration factor Kt is a function of the thickness 't', the horizontal pitch 'Ph', and the interval 'L' between the welding spots, and an appropriate adjustment of the factors renders a range in which the stress concentration is minimized, which implies that, if the interval 'L' between the welding spots is adjusted appropriately, the formation of wrinkles can be prevented even if both the thickness 't' and the pitch 'Ph' are reduced.

Influences of the thickness 't' of the shadow mask and the interval 'L' between the welding spots to the occurrence of wrinkles are known from computer simulations. The intervals 'L' between the welding spots are set as multiples of the thickness 't' of the shadow mask, i.e., from 5 times to 23 times of the thickness, and occurrence of wrinkle is examined for each case. As a result of the examination, it is verified that no wrinkles are occurred in cases when the intervals 'L' between the welding spots are on a range approx. 11 to 19 times of the thickness 't' of the shadow mask, and the wrinkles are occurred when the intervals 'L' are outside of the range.

Next, influences of the slot pitch 'Ph' of the shadow mask and the interval 'L' between the welding spots to the occurrence of wrinkles are known from computer simulations. As a result of simulation with the intervals 'L' between welding spots set to be 0.3 to 2.1 times of the pitch 'Ph', it is verified that no wrinkles are occurred in cases when the intervals 'L' between the welding spots are on a range approx. 0.5 to 1.9 times of the pitch 'Ph' of the shadow mask.

The computer simulations are confirmed by actual tests. As a result, it becomes known that the most stable interval 'L' between the welding points at which the wrinkles are not occurred in the vicinity of the welding spot is 1.1–1.2 mm when the shadow mask has a thickness 't' of 0.08–0.1 mm, and the slot pitch 'Ph' is 0.8 mm. The interval 'L' of welding spots corresponds to approx. 11–15 times of the thickness 't' of the shadow mask, and 1.3–1.5 times of the slot pitch 'Ph'. That is, it is confirmed by test too that, when the interval 'L' is set by the method suggested in the present invention, no wrinkles are occurred in the vicinity of the welding spot.

Along with this, the inventor has verified that the stress concentration factor Kt is related to a form of the welding spot itself locally, as follows.

$$Kt=f(a, b, b/a)$$

Where, 'a' denotes a height of the welding spot, 'b' denotes a width of the welding spot, and 'b/a' denotes an aspect ratio thereof. That is, it is verified that, as shown in FIG. 7, the stress concentration factor Kt is also a function of the height 'a', the width 'b', and the aspect ratio 'a/b' of the welding spot on the shadow mask as well as the interval 'L' of the welding spots taken into consideration in an overall form of the shadow mask before, and, alikely, an appropriate adjustment of the factors renders a range in which the stress concentration is minimized, which implies that, if the form of the welding spots is adjusted appropriately, the formation of wrinkles can be prevented even if both the thickness 't' and the pitch 'Ph' are reduced, as the foregoing factors that can minimize the stress concentration are the height 'a', the width 'b', and the aspect ratio 'b/a' of the welding spot.

An influence of the form of the welding spot to the occurrence of wrinkles is made known from a computer simulation. The occurrence of wrinkles is examined, with the height 'a' of the welding spot set to 0.3–2.0 mm, respectively. As a result, it is known that no wrinkles occur in the case that the height 'a' is in a range of approx. 0.6–0.9 mm, but the wrinkles occur when the height 'a' is outside of this range. Next, an influence of the width 'b' of the welding spot to the occurrence of wrinkles is made known from a computer simulation. The occurrence of wrinkles is examined by simulation, with the width 'b' of the welding spot set to 0.3–2.0 mm, respectively. As a result, it is known that no wrinkles occur in the case that the width 'b' is in a range of approx. 1.0–1.4 mm. Next, in order to examine occurrence of wrinkles by an influence of the aspect ratio 'b/a' of the welding spot, occurrence of wrinkles is examined by simulation, with the aspect ratio 'b/a' of the welding spot set to 0.4–3.6, respectively. As a result, it is known that no wrinkles occur in the case that the aspect 'b/a' is in a range of approx. 1.0–2.6.

The foregoing computer simulations are confirmed by actual tests. As a result, it becomes known that the most stable form of the welding points at which the wrinkles are not occurred in the vicinity of the welding spot is of approx. 0.7–0.8 mm height 'a', approx. 1.1–1.2 mm width 'b', and approx. 1.3–1.7 aspect ratio 'b/a' when the shadow mask has a thickness 't' of 0.08–0.1 mm, and the slot pitch 'Ph' is 0.8 mm. That is, it is confirmed by test too that, when the form of the welding spot is set according to the method suggested in the present invention, no wrinkles are occurred in the vicinity of the welding spot.

As has been explained, the shadow mask in a color cathode ray tube of the present invention has the following advantages.

First, the present invention permits to set up an optimal form of the welding spot that causes to form no wrinkles regardless of the thickness and the pitch, thereby preventing defective shadow mask coming from occurrence of wrinkles effectively, to improve productivity and to save cost by reduction of defects.

Second, a form of a welding spot suitable for reduced thickness and/or pitch of the shadow mask can be fixed for prevention of occurrence of wrinkles after welding, permitting to provide a thinner shadow mask and a finer pitch of slots, that allows to provide a high precision and light weighted cathode ray tube.

It will be apparent to those skilled in the art that various modifications and variations can be made in the shadow mask in a color cathode ray tube of the present invention without departing from the spirit or scope of the invention. Thus, it is intended that the present invention cover the modifications and variations of this invention provided they come within the scope of the appended claims and their equivalents.

What is claimed is:

1. A shadow mask in a color cathode ray tube, comprising: an effective surface part comprising a plurality of slots formed therein for passing electron beams; and an edge part extended from the effective surface part and welded to a frame fitted to a panel in a cathode ray tube, wherein the shadow mask is tensed in any one of x- and y-axis directions, wherein an interval of welding spots on the edge part is fixed according to a thickness of the shadow mask and a pitch of slots of the shadow mask, and wherein the interval of the welding spots is in a range of 11 to 17 times the thickness of the shadow mask.

2. The mask as claimed in claim 1, wherein the interval of the welding spots is in a range about 11–15 times the thickness of the shadow mask.

3. A shadow mask in a color cathode ray tube, comprising:

an effective surface part comprising a plurality of slots for passing electron beams; and an edge part extended from the effective surface part and welded to a frame fitted to a panel in a cathode ray tube, wherein the shadow mask is tensed in any one of x- and y-axis directions, wherein an interval of welding spots on the edge part is fixed according to a thickness of the shadow mask and a pitch of the slots in the shadow mask, and wherein the interval of the welding spots is in a range about 0.5–1.9 times the slot pitch of the shadow mask.

4. The shadow mask as claimed in claim 3, wherein the interval of the welding spots is in a range about 1.3–1.5 times the slot pitch of the shadow mask.

5. A shadow mask in a color cathode ray tube, comprising:

an effective surface part comprising a plurality of slots for passing electron beams; and an edge part extended from the effective surface part and welded to a frame fitted to a panel in a cathode ray tube, wherein the shadow mask is tensed in any one of x- and y-axis directions, wherein an interval of welding spots on the edge part is fixed according to a thickness of the shadow mask and a pitch of slots of the shadow mask, and wherein each welding spot has an aspect ratio in a range of about 1.0–2.6.

6. The shadow mask as claimed in claim 5, wherein each welding spot on the edge part has a height in a range of about 0.6 mm–0.9 mm.

7. The shadow mask as claimed in claim 5, wherein each welding spot on the edge part has a width in a range of about 1.0 mm–1.4 mm.

8. The shadow mask of claim 2, wherein the thickness of the shadow mask is about 0.08 mm to 0.1 mm and the slot pitch is about 0.8 mm.

9. The shadow mask of claim 4, wherein the thickness of the shadow mask is about 0.08 mm to 0.1 mm and the slot pitch is about 0.8 mm.

10. The shadow mask of claim 5, wherein a height of the spot welds is about 0.7 mm to 0.8 mm, a width of the spot welds is about 1.1 mm to 1.2 mm, an aspect ratio of the spot welds is about 1.3 to 1.7, the thickness of the shadow mask is about 0.08 mm to 0.1 mm, and the slot pitch is about 0.8 mm.

11. A shadow mask and frame assembly, comprising: a shadow mask; a frame; and a spot welds attaching the shadow mask to the frame, wherein at least one parameter of the spot welds is configured in accordance with at least one of a thickness, a slot pitch of the shadow mask, or a combination thereof to prevent wrinkles in the shadow mask, wherein an interval between spot welds is 11 to 17 times the thickness of the shadow mask.

12. The assembly of claim 11, wherein the at least one parameter comprises an interval between spot welds.

13. The assembly of claim 12, wherein the interval between spot welds is about 0.5 to 1.9 times the slot pitch of the shadow mask.

14. The assembly of claim 12, wherein the interval between spot welds is about 11 to 15 times the thickness of the shadow mask, and about 1.3 to 1.5 times the slot pitch of the shadow mask.

15. The assembly of claim 14, wherein the slot pitch of the shadow mask is about 0.8 mm, the thickness of the shadow mask is about 0.08 mm to 0.1 mm, and the interval between spot welds is about 1.1 mm to 1.2 mm.

16. The assembly of claim 11, wherein the at least one parameter comprises an interval between the spot welds, a height of the spot welds, a width of the spot welds, an aspect ratio of the spot welds, or a combination thereof.

17. The assembly of claim 16, wherein the at least one parameter comprises a height of the spot welds and the height of the spot welds is about 0.6 mm to 0.9 mm.

18. The assembly of claim 16, wherein the at least one parameter comprises a width of the spot welds and the width of the spot welds is about 1.0 mm to 1.4 mm.

19. The assembly of claim 16, wherein the at least one parameter comprises an aspect ratio of the spot welds and the aspect ratio of the spot welds is about 1.0 to 2.6.

20. The assembly of claim 16, wherein the at least one parameter comprises a combination of a height, a width, and an aspect ratio of the spot welds, and the height of the spot welds is about 0.7 mm to 0.8 mm, the width of the spot welds is about 1.1 mm to 1.2 mm, and the aspect ratio of the spot welds is about 1.3 to 1.7, and wherein the thickness of the shadow mask is about 0.08 mm to 0.1 mm, and the slot pitch is about 0.8 mm.

* * * * *